US006435975B2

(12) United States Patent
Middleton

(10) Patent No.: US 6,435,975 B2
(45) Date of Patent: Aug. 20, 2002

(54) GOLF CLUB AND METHOD OF USE

(76) Inventor: Nicholas Mark Middleton, 144 Meadow Head, Sheffield (GB), S8 7UF ( * ) Notice: Subject to any disclaimer, the term of this patent is extended or adjusted under 35 U.S.C. 154(b) by 0 days.

(21) Appl. No.: 09/971,319

(22) Filed: Oct. 3, 2001

Related U.S. Application Data

(63) Continuation of application No. 09/491,570, filed on Jan. 26, 2000, now abandoned.

(30) Foreign Application Priority Data

Jan. 29, 1999 (GB) ..... 9901964

(51) Int. Cl.[7] ..... A63B 69/36; A63B 53/04

(52) U.S. Cl. ..... 473/231; 473/257; 473/231; 473/242; 473/235; 473/341; 473/409

(58) Field of Search ..... 473/131, 231, 473/238, 257, 258, 260, 261, 268, 280, 242, 249, 251, 219, 235, 200, 409, 286, 313, 314, 340, 252, 341, 324; 434/252

(56) References Cited

U.S. PATENT DOCUMENTS

| | | | | |
|---|---|---|---|---|
| 2,465,124 | A | | 3/1949 | Quattrin |
| 2,709,595 | A | * | 5/1955 | De Vries |
| 3,343,839 | A | | 9/1967 | Borah |
| 3,434,722 | A | | 3/1969 | Esposito |
| 3,632,112 | A | * | 1/1972 | Jacobs |
| 3,708,172 | A | * | 1/1973 | Rango |
| 3,779,398 | A | | 12/1973 | Hunter |
| 3,966,210 | A | * | 6/1976 | Rozmus |
| 4,002,343 | A | * | 1/1977 | Eckert |
| 4,248,430 | A | * | 2/1981 | Kepler |
| 4,580,784 | A | | 4/1986 | Brill |
| 4,688,798 | A | * | 8/1987 | Pelz |
| 4,809,977 | A | | 3/1989 | Doran et al. |
| 4,809,981 | A | * | 3/1989 | Doran |
| 4,962,927 | A | | 10/1990 | Colucci |
| 4,976,436 | A | * | 12/1990 | Serizawa |
| 5,388,827 | A | | 2/1995 | Reynolds, Jr. |
| 5,409,228 | A | | 4/1995 | Botsch |
| 5,417,426 | A | | 5/1995 | Bayer |
| 5,524,895 | A | * | 6/1996 | Nakajima |
| 5,595,546 | A | * | 1/1997 | Masters |
| 5,692,968 | A | | 12/1997 | Shine |
| 5,725,441 | A | | 3/1998 | Jensen et al. |
| 5,885,165 | A | * | 3/1999 | Krause |

* cited by examiner

*Primary Examiner*—Sebastiano Passaniti
(74) *Attorney, Agent, or Firm*—Cislo & Thomas LLP

(57) ABSTRACT

There is disclosed a putter and an attachment for a putter. The putter head has at least one striking face, a rear face and side faces or edges defining a body of a predetermined thickness to which a shaft is attached. Within the body of the putter head there is provided either a recess which opens into the rear face of the head or a closed aperture completely defined within the body which is of marginally greater dimensions than, and adapted to receive a conventionally sized golf ball. The recess or aperture is disposed substantially centrally of the head behind striking face of the putter so that the sweet spot on the striking face is substantially centrally disposed of said recess or aperture. Ideal toe-heel weight distribution can be achieved in this manner, and the putter can be used as a practicing aid by swinging the putter proximate a floor when a golf ball is disposed within said recess or aperture. When the putter is swung so that it is no longer proximate the floor, the golf ball is released and its momentum causes the ball to continue rolling along the floor in a direction imparted to it by the swinging of the putter. The swing profile of a user can thus be quickly assessed. The attachment is simply a device which attaches to the rear of a conventional putter as a training aid and functions in an identical manner.

9 Claims, 3 Drawing Sheets

GOLF CLUB AND METHOD OF USE

CROSS-REFERENCE TO RELATED APPLICATIONS

This Application is a continuation of U.S. patent application Ser. No. 09/491,570 filed on Jan. 26, 2000, now abandoned which by this reference is incorporated as if fully set forth herein.

SEQUENCE LISTING

Not Applicable.

STATEMENT REGAREDING FEDERALLY SPONSORED RESEARCH AND DEVELOPMENT

Not Applicable.

BACKGROUND OF THE INVENTION

A. Field of the Invention

This invention relates to golf clubs, and more particularly to putters which are used in the game of golf to strike the ball along the surface of a green.

B. Description of the Related Art

Golf is generally played on courses having eighteen or nine holes having "tees" at one end of the hole from which a ball is initially struck by a player and a green provided with a hole therein at the alternate end. The tee and the green are separated by a fairway and the general principle behind the game of golf is to deposit the ball in the hole on the green with as few strikes of the ball as possible.

Putters are typically used on the greens and on the fringes surround the greens to strike the golf ball towards the hole with the aim of depositing the ball in said hole. The hole is only of the order of 12 centimeters in diameter and when it is considered that putts, which term is commonly used to describe the strokes taken with a putter, may often be in excess of 12 meters (40 feet), it will be understood that great accuracy is required to ensure that the resulting position of the ball after the stroke is at least proximate if not within the hole. In general, the distance of the ball from the hole is proportional to the likelihood that the putt will be missed, i.e. further putts will be required to deposit the ball in the hole.

It is well known in the game of golf that a significant element of the professional game is centred on putting, and poor putters of the ball rarely achieve results. Indeed the difference between the scorecards of players with equal "tee to green" ability, but different putting ability is immediately evident.

It is surprising that there are currently relatively few putting training devices available, especially when it is considered that putting is such an essential element of the game. One device which is available, but adapted for conventionally indoor use, consists of a plastic tray provided with a U-shaped inclined channel which narrows along its length, one end of the channel being closed off and located substantially centrally and above the base of the device, the alternate end being open and wide enough to receive a regulation-sized golf ball. The channel is typically integrally moulded into the device such that, on placing the device on a carpet or the like, the wider open end of the channel coincides with the periphery of the device to create a sharp lower edge which rests on the said carpet. The channel is inclined upwardly from the wider open end to the closed off end which is within the body of the device. Also within the device there is provided a battery powered ejector mechanism.

In use the device is placed on a carpet, and a user wishing to practice his putting stands some distance away from the device and putts balls towards the device, which is disposed with the wider open end of the channel facing towards the user. The provision of a sharp lower edge of the channel which rests on the carpet facilitates the passage of a ball accurately struck along the said carpet by the user into the channel and towards the closed off end thereof provided in the device. A ball struck by a putter with the correct weight and accuracy of direction towards the device will locate itself in the closed end of the channel, which is provided with a slight recess and moulded to the spherical shape of a golf ball. The battery powered ejector mechanism then detects the presence of a ball in the closed end of the channel and ejects same back down the inclined channel towards the putter who can again attempt to putt the ball with said correct weight and direction. It can be appreciated that a good putter of the ball will be capable of repeatedly striking the ball such that it is received by the narrowing channel and located in the recess at the closed end thereof.

The primary and pervasive disadvantage of such training devices is that they do not address any of the often numerous imperfections in the putting stroke of the player. In order to strike a golf ball with a putter directionally accurately, a smooth unerring swing is required. In particular, it is generally believed that the arc along which the putter head travels as it is taken away from the stationary ball during the "backswing," the arc which the putter head follows as it is returned to the ball to strike same, and the arc followed thereby after the ball has been struck, i.e. follow through, are to be part of the same imaginary circle whose centre is approximately between the shoulders of the golfer. Furthermore, the diameter of said circle in the direction which it is desired to strike the ball must be parallel to the plane containing the legs of the player. If this were not the case, the putting stroke of the player would either slice the ball at impact from above when viewed from above, or would push the ball from below. In any event, an undesirable component of velocity would be imparted to the ball at impact with the face. The only component of velocity ideally imparted to the ball at impact is in the desired striking direction. In this case the ball simply rolls in the direction in which it was struck.

SUMMARY OF THE INVENTION

It is an object of this invention to provide a putting device which allows a player to analyse whether he is imparting any undesirable velocity components to the ball at impact.

It is a further object of this invention to provide a putter which does not infringe current regulations concerning putter configurations and which can therefore be used in competition.

It is a still further object of this invention to provide a putter which can be used in a variety of different ways to immediately indicate the accuracy of the putting stroke of a player.

It is a yet further object of the invention to provide a putter which when used in training, enables a user to "groove" his putting stroke by ensuring that the arcuate rotational travel of the putter head conforms to the theoretical optimum described above, in particular by conforming the backswing and follow through of the player to the optimum described before and after impact respectively.

It is a further object of the invention to provide a training device which defocusses the mind of the user on the actual point of impact, and increases the concentration of that user on the particular arc of swing during the stroke.

According to the present invention there is provided a putter comprising a head with at least one striking face, a rear face or edge and side faces or edges, any of which may be curved, said edges or faces defining a putter body of a predetermined thickness, a shaft being optionally attached to said head, said head having at least one further arcuate face or edge or further planar faces or edges defining a recess between the side faces or edges and throughout the thickness of the body, wherein the recess defined by said further faces or edges is adapted to receive a conventional golf ball behind the striking face of the putter and restrict the movement thereof in a direction parallel to the striking face when the said ball is in contact with the said further faces or edges during the swinging of the putter by a user.

It is to be pointed out that the shaft does not comprise a feature of the invention, and accordingly the invention provides a putter head as described above.

In a first embodiment of the invention the recess opens to the rear face or edge of the putter, and in a second alternative embodiment, the recess is closed to form an aperture within the body of the putter. Preferably the aperture is circular and of a diameter marginally greater than the diameter of a conventional golf ball.

Preferably, the recess of the first embodiment is defined at least on two sides by the further faces or edges within the body, the separation of the faces or edges being marginally greater than the diameter of a conventional golf ball.

In the former embodiment, the further faces or edges are preferably substantially parallel and perpendicular to the striking face. Further preferably said further faces or edges are provided substantially equidistantly from the centre of the striking face, and accordingly can have the additional function of alignment means.

In any event the head of the putter is preferably provided with additional alignment means which allow the user of the putter to position the striking face squarely to the desired direction of travel of the ball after striking thereof.

Preferably additional weighting elements are provided in the body of the putter head on either side of the recess to provide a balanced "toe/heel" weight distribution. The toe and the heel of the putter head are those regions towards the extremities of the striking face and providing such a weight distribution across the striking face reduces the twisting moment imparted to the putter head on impact with the ball when the point of impact is displaced from the centre of the striking face.

Preferably the putter head is a "mallet" type putter head.

According to a third aspect of the invention there is provided an attachment for a putter head capable of being attached thereto by any suitable means, said attachment having an attachment location and at least one arcuate face or edge or further planar faces or edges defining a recess therebetween, said recess being defined behind the putter head, wherein the recess is adapted to receive a conventional golf ball and restrict the movement thereof in a direction parallel to the striking face when the said ball is in contact with the said faces or edges during the swinging of the putter by a user.

Preferably the attachment is provided with an arcuate hoop behind the attachment location, the edges or faces defining same having a separation which is marginally greater than that of the diameter of a conventional golf ball.

In an alternative embodiment, the attachment may be provided with a pair of spaced limbs extending substantially parallel and rearwardly of the attachment location, the separation of said limbs being marginally greater than the diameter of a conventional golf ball.

Preferably the attachment means ensures uniform and repeatable attachment to the said putter head.

Preferably the putter conforms to the regulations concerning putters of the Royal and Ancient (R&A) Golf Association. In this case the putter of the present invention can be used in competitions. Other training devices are either impossible to use in competition or do not conform to the regulations of the R&A. Henceforth the uniformity of putting stroke acquired during training is not immediately lost once playing on the golf course, as is so often the case with current training means employed by golf professionals.

Preferably, in the case where an aperture in the putter head throughout the thickness thereof is defined by the said further faces or edges, said aperture is substantially centrally located of the putter head body considered as a whole. However, different locations of the aperture may be provided depending on personal choice.

Regardless of the position of the aperture, a heel-to-toe weight distribution will automatically be achieved because the removal of matter from the body head in the manner described automatically increase the relative weights towards the extremities of the striking face.

It has been postulated that a larger sweet spot (that area of the sulking face which when impacted causes resonant dynamics within the body of the putter head) can be achieved if the aperture is provided towards the rear of the putter head body. Experimentation may define the precise location of the said aperture to give rise to the largest sweet spot.

BRIEF DESCRIPTION OF THE DRAWINGS

The understanding of the invention will be enhanced by the following specific description in which reference is made to the accompanying diagrams wherein.

DETAILED DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
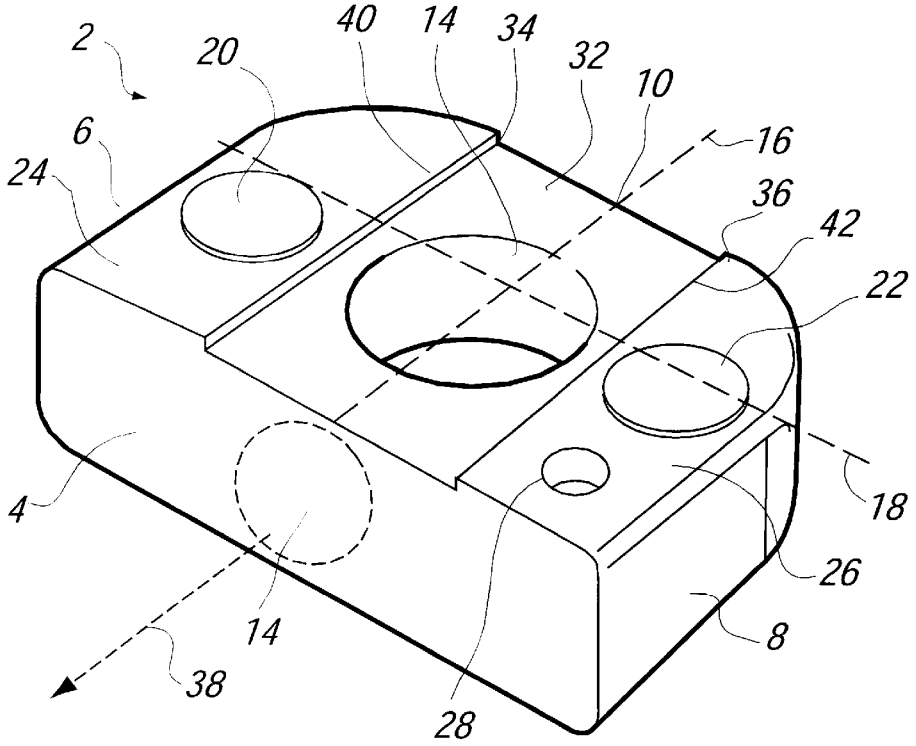
FIG. 1 shows a perspective view of a putter head according to the invention.

Referring firstly to FIG. 1 there is shown a putter head 2 provided with a striking face 4, side faces 6, 8 and a rear face 10 which in general define a central body 12 of the putter head. An aperture 14 is provided within the body 12 and extends throughout the entire thickness thereof. It will be appreciated that although the aperture 14 is substantially symmetrically disposed within the body 12 of the putter head 2 about both a lateral axis 16 and a longitudinal axis 18, the precise disposition of the centre of the aperture may be moved within the body 12 so as to be offset from either of the said axes 16, 18 according to choice or experimentation regarding the position and size of the sweet spot indicated generally at 14 on the striking face 4. It will further be appreciated that altering the location of the aperture 14 alters the dynamic and vibrational characteristics of the putter head, and such characteristics can be further altered by providing a toe weight 20 and/or a heel weight 22 in the toe or heel portions 24, 26 respectively of the cutter head 2. Henceforth, it will be understood that a large number of modifications and variations may be made to the putter head 2 as desired.

Figure 3:
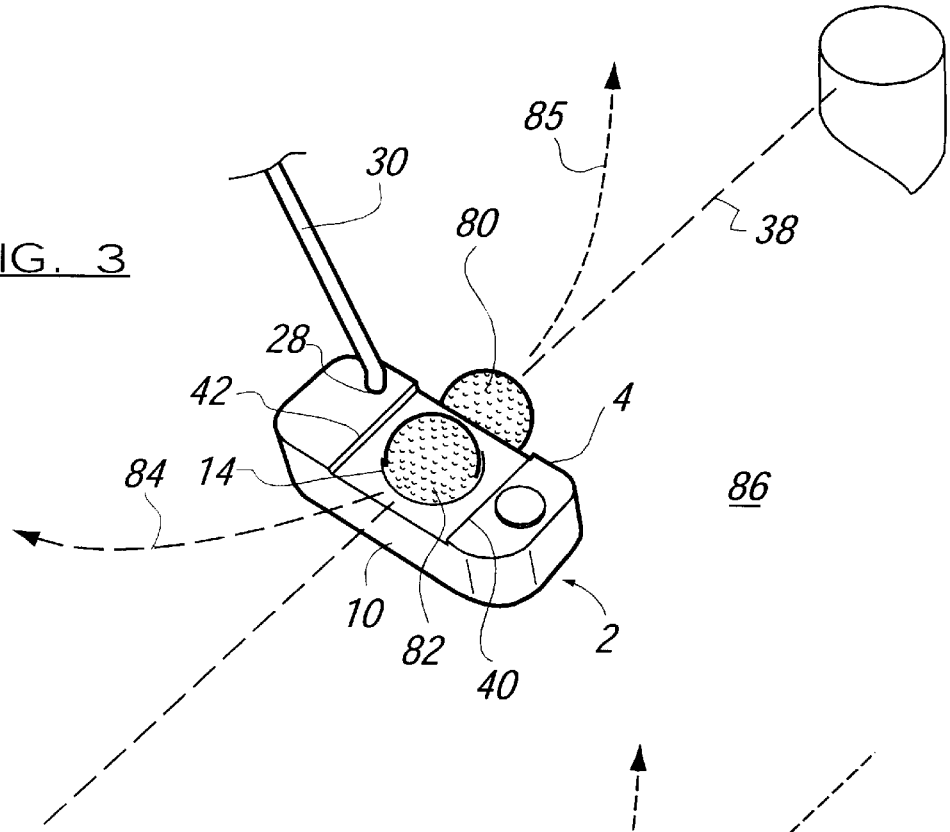
FIGS. 3 to 5 show perspective views of the mode of operation of the putter as a training device.
Figure 4:
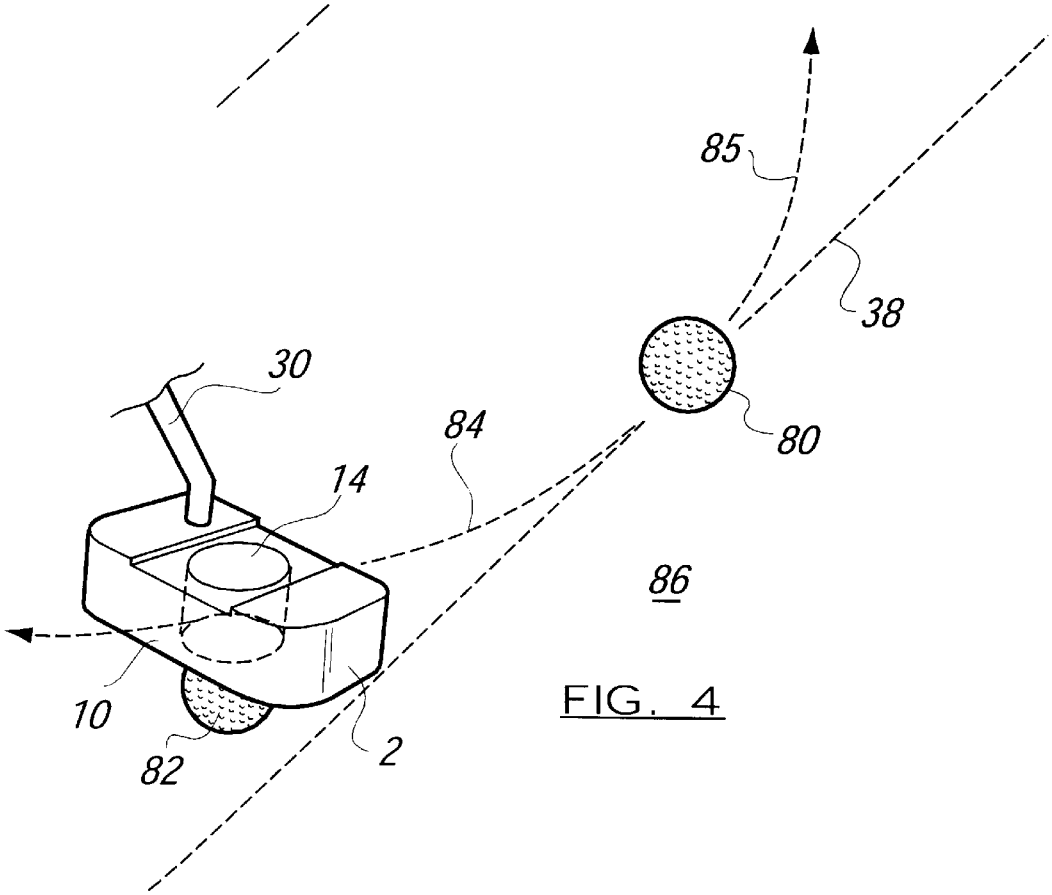
Figure 5:
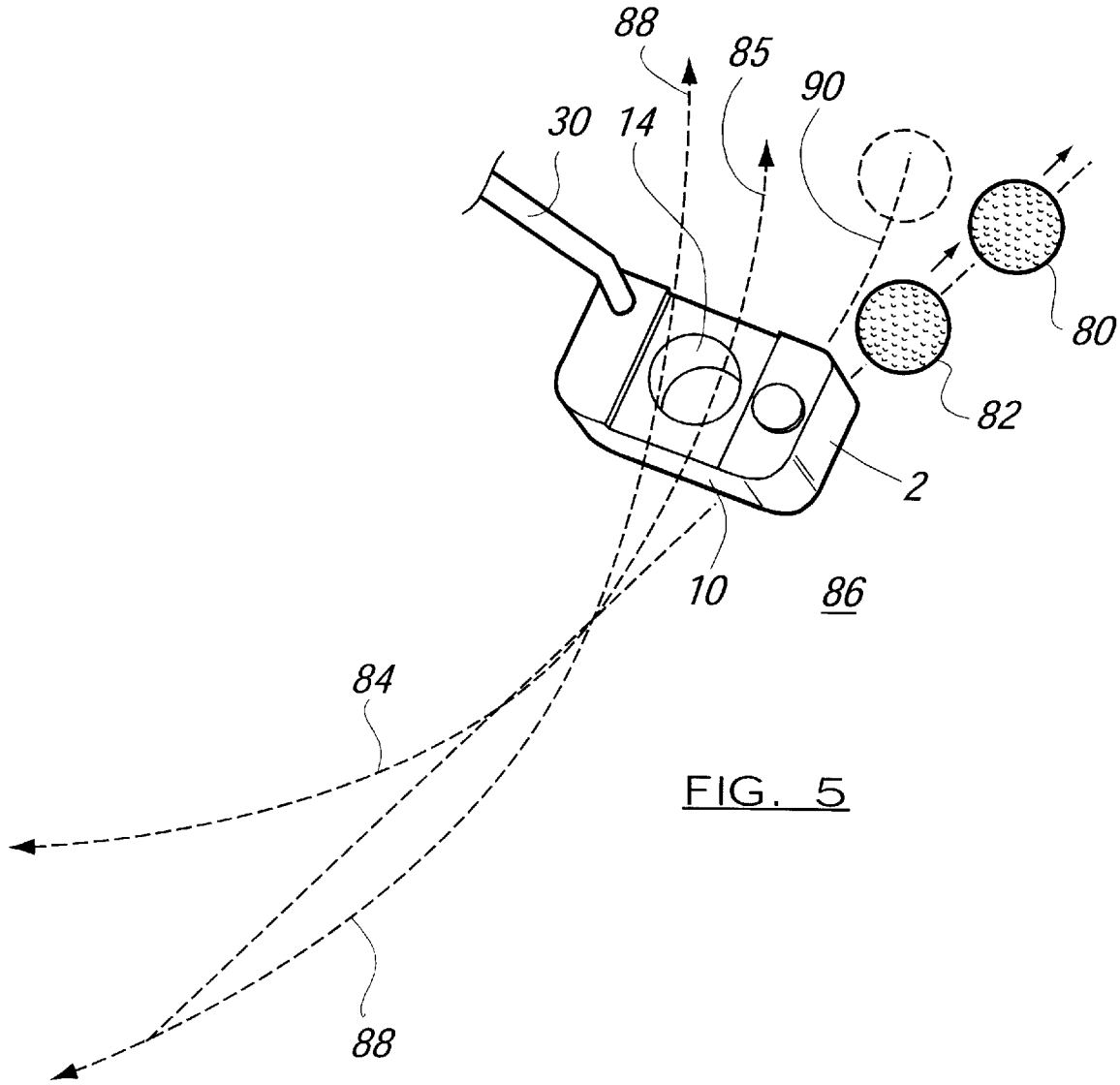

The heel region 26 is further provided with a recess 28 to which a putter shaft may be connected to allow the putter to be swung by a user. Such a shaft is shown in FIGS. 3 to 5 at 30. Although the putter head of FIG. 1 is shown as a mallet type putter head, it will be immediately understood that a wide variety of shapes can be employed. The putter head of FIG. 2 is further provided with a channelled region 32 having edges 34, 36 which is set back from the upper surfaces of the toe and heel portions 24, 26. Although this feature is not essential to the invention, a putter provided with such a feature can be aligned with the desired direction of travel of a ball struck by the striking face 4 as shown at 38, as the said channel sides 34, 36 define discreet edges 40, 42 which are substantially parallel with the desired striking direction 38, and perpendicular to the striking face 4.

Figures 2A, 2B, 2C, 2D:
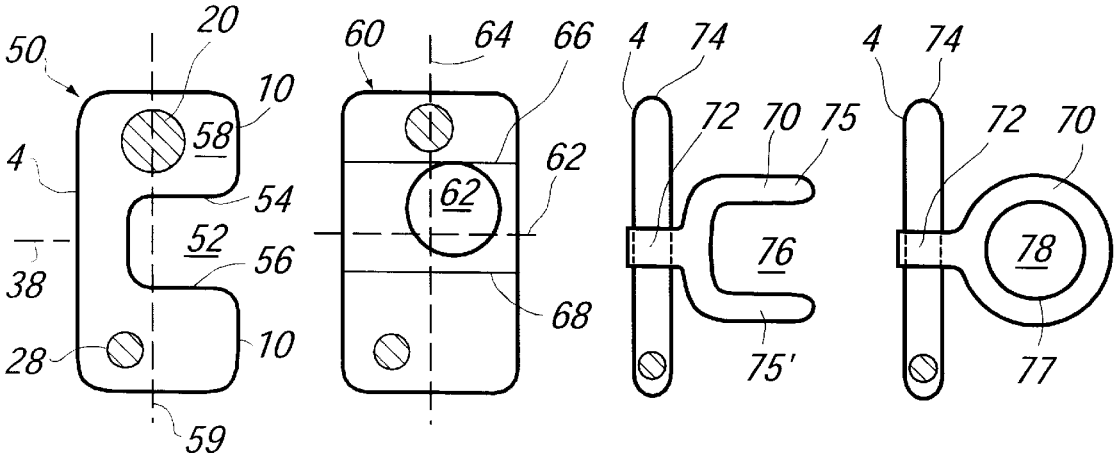
FIG. 2*a* to 2*b* show plan views of modified putter head constructions falling within the scope of the invention.
FIGS. 2*c* to 2*d* show a plan view of an attachment according to a modified aspect of the invention as attached to a blade putter head.

Referring now to FIGS. 2*a* and 2*b*, alternative configurations of putter head 2 are shown. In FIG. 2*a*, the putter head 50 is not provided with an aperture, but with a recess 52 in the rear face of the putter head. Correct alignment of the putter can be achieved as a result of the further internal faces 54, 56 which define the recess 52, because said faces define edges in the uppermost surface 58 of the putter head which are both parallel with the desired direction of striking and perpendicular to the striking face 4 in similar manner to the edges 40, 42 described above in relation to FIG. 1.

A further putter head 6 is shown in FIG. 2 and is provided with an aperture 62, the centre of which is offset from both the lateral axis 62 and the longitudinal axis 64. Alignment means 66, 68 are provided in a similar manner to that described in relation to FIG. 1.

A primary characteristic of the invention is that said apertures and recess are of marginally greater relevant dimensions than the diameter of a conventional golf ball and accordingly such a golf ball can be received in a toleranced manner in said apertures and recess. In the case of the recess 52 the distance between the edges 54, 56 is marginally greater than the diameter of a conventional golf ball, whereas the diameter of the circular apertures 14, 62 are marginally greater than the golf ball diameter. Accordingly, the said apertures and recess prevent significant movement of the golf ball in the direction of the longitudinal axes 18, 64 and in the case of FIG. 2*a*, 59 during the back swing and follow through of the putter stroke. This feature is more fully explained with reference to FIGS. 3 to 5.

Referring now to FIGS. 2*c* and 2*d*, it can be seen that an attachment 70 provided with attachment means 72 which ideally does not interfere with the striking face 4 of a putter head 74 is provided and functions in a broadly identical manner to the apertures 14, 62 and recess 52 described in relation to FIGS. 1, 2*a* and 2*b*. In both FIGS. 2*c* and 2*d*, the relevant dimensions of the attachment 70 are marginally greater than the diameter of a conventional golf ball, in order that such may be received within either the recess 76 defined by a pair of rearwardly extending limbs 75, 75' in the case of FIG. 2*c*, and by the internal walls 77 of a circular hoop in the case of FIG. 2*d*. The said walls 75, 75', or 77 prevent any significant movement of the golf ball in a direction parallel to the striking face 4 of the putter head during the putting stroke.

Referring now to FIGS. 3 to 5, a putter head 2 is described in FIG. 1 is provided with a shaft 30 which is gripped by a user (not shown) and aligned by said user along a desired direction of striking 38. Such alignment is crucial in accurate putting and is aided by the provision of edges 40, 42 in the upper surface of the putter head 2 which allow a user to ascertain the orientation of the striking face 4 of the putter with the desired striking direction 38. It is to be pointed out the material from which the club head is manufactured may not permit the provision of a channel as described, and accordingly the edges 40, 42 may be replaced by painted lines applied to the upper surface of the club face.

During play on a golf course, obviously no marking of the desired striking direction exists and the user has only the alignment edges 40, 42 to aid his alignment of the putter such that the striking face 4 is exactly perpendicular with the imagined desired striking direction.

In order to train using the putter head 2, a pair of golf balls 80, 82 is provided, the first golf ball 80 being positioned in front of the striking face 4 and the second of the golf balls 82 being disposed within the aperture 14 provided in the putter head 2. The aim of the putting training device of the invention is to ensure both that exact perpendicularity is achieved between the striking face 4 and the desired striking direction 38 during impact between the said striking face 4 and the ball 80, and furthermore to ensure that a correct arc of swing is achieved by a user during every putting stroke.

This is achieved as follows:

In FIG. 4, the putter head 2 has been drawn back from the ball 80 along a back swing arc 84 to the position shown. It can be seen from the figure that the ball 82 is supported only by the ground 86 on which the training is being conducted and accordingly as the putter head is rotated about the back swing arc 84 and rises above the ground 86, the ball 82 simply drops from within the aperture 14 under gravity, but is nevertheless confined to travel along the line of the desired striking direction 38, except in opposite fashion. It can be seen from the figure that at the extremity of the back swing to the user, the putter is of such a thickness that the ball 82 is not completely released from within the aperture 14, but is partially retained by the walls of said aperture approximate the lowermost surface of the putter 2.

It is a common flaw of players who are poor putters to break their wrists during the putting stroke and also to concentrate too specifically on the point of impact as opposed to the arc of swing which gives rise to an accurate direction of strike.

With regard to the first flaw, although not shown in any of the diagrams, the arms and wrists of the player ideally remain rigid throughout the putting stroke, with only the shoulders rotating to effect the stroke, and in this manner a uniform and accurate direction of strike is achieved. The breaking of the wrists during the stroke results in the putter head rising above the ground during the backswing and follow through to greater degree than when the arms and wrists of the player remain rigid. The training device of the present invention allows a poor putter to quickly correct this deficiency because the ball 82 will be released from within the aperture if the wrists of the player break during the stroke, whereas during a correctly executed stroke, the wrists would not break and the putter head would rise above the ground 86 only gradually and to a lesser degree. It is to be further pointed out that the putter of the present invention may be used as a training device with only a single ball 82, and in such configuration could be used simply to hone the putting stroke of the player by ensuring that the player retains the ball 82 within the aperture 14 at all times during a stroke.

With regard to the second flaw, the training device according to the invention defocusses the mind of the user from the impact between the striking face and the ball, and indeed such impact need not actually occur (at discussed above there is no need to provide an object ball 80 which is to be struck by the putter). This form of training can be invaluable in teaching players to "play through the ball" without concentrating specifically on the impact of the face therewith. In all sports, the mental approach of doing mote than is actually requited, for example in sprinting where sprinters run towards a point past the line, is unequivocally believed to result in improved performance. Accordingly the training device of the invention accomplishes this.

As the putter head begins its down swing from the position shown in FIG. 4 to the position shown in FIG. 5, the ball 82 remains trapped within the aperture 14 until such time as the putter head 2 is raised a distance at least equal to the diameter of the golf ball 82 above the ground 86. At this stage, the ball 82 is released from within the aperture 14 and as a result of the angular velocity of the putter head 2 at this time, the ball 82 is imparted with a forward velocity directly proportional to the angular velocity of the said putter head. It is important to note that as the putter head 2 is returned from the position shown in FIG. 4 to the stationary position of FIG. 3, the striking face 4 impacts the ball 80 and thus imparts a forward velocity to said ball. On account of this impact, and the fact that the angular velocity of the putter head after impact is generally lower than that at impact, the ball 82 will have imparted thereto a lower velocity than the ball 80, and accordingly will lag somewhat behind the said ball 80.

The putter head described acts as a training device in that it is possible for a user of the putter provided with a putter head 2 to ascertain whether the arc of his follow through as shown at 85 is in the correct plane. If this is the case, then the direction of the velocity imparted to the ball 82 will be identical to that direction in which the ball 80 is already travelling, and ideally both of these said directions will be identical to the desired striking direction 38.

A common fault of poor putters of the golf ball is the tendency to drag the putter head towards the body after striking the ball 80, and in such circumstances the putter head 2 would follow a path indicated generally by the dotted line 88. If a player whose arc of swing of the putter head 2 is habitually along an incorrect path such as 88, the fault of that player will be immediately evident on using the training device according to the invention because although the ball 80 may travel at least to some extent along the desired striking direction 38, the secondary ball 82 will be released from within the aperture 14 of the putter head in a direction indicated generally by the dotted line 90. Such instantaneous appraisal of an incorrect putting arc of swing has heretofore been impossible with currently existing putting training devices.

It will be appreciated that the putter heads shown in FIGS. 2*a* and 2*c* operate in a different manner to the putter heads shown in FIGS. 1, 2*b* and 2*d* in that a marking on the ground 86 along the desired striking direction 38 both in front of the striking surface before and behind the putter head 2 is required. The putter head shown in FIGS. 2*a* and 2*b* are ideally adapted to conform the arc of swing of a player to the correct theoretical arc 84 in the back swing phase of the putting stroke. Henceforth, a ball disposed within the recesses 52, 76 will travel along the marked desired striking direction 38 away from the putter head when said head teaches the extremity of the back swing, and in the case where an incorrect arc of swing is habitually adopted by a player such as that shown at 88 in FIG. 5, the direction of travel of the ball away from the putter head will vie away from marked desired striking direction 38. Accordingly, it is possible to use the putter head shown in FIG. 1 in a training method wherein three conventional golf balls are used, two being in the positions shown of golf balls 80, 82 in FIG. 3 and a third golf ball (not shown) disposed immediately behind and adjacent the rear face 10 and also directly above a marked line indicating the desired striking direction 38. In such method, both the back swing and the follow through of the stroke of the player can be conformed to the correct theoretical arc of swing denoted by 84 and 85 by ensuring that the second golf ball 82 travels along an identical path to that taken by the ball 80 after impact, and also by ensuring that the third golf ball moves in a direction. of the marked line indicating the desired striking direction 38 but in a reverse manner to the balls 80, 82.

A number of additional features may be. provided in a putter head having the configurations shown in FIGS. 1, 2*a*, 2*b*. In particular, more than a single aperture 14 may be provided, one being disposed towards the toe 24 and the other being disposed towards the heel 26 of the putter head 2. In such circumstances, a pair of golf balls may be disposed within the two apertures of the putter head which, when in use as a training device, would impart a velocity to both the said golf balls disposed in the said aperture on either side of a desired striking direction 38. Imperfections in the arc of swing of a player would accordingly become evident with even more clarity than would be the case with the putter head 2, and furthermore, such a modified putter head may be of use in assessing the particular orientation of the striking surface at impact and thereafter.

It has further been proposed to provide a variety of different insert or plugs which could be inserted in the aperture when the putter is being used in conventional play to provide desired dynamic and vibration characteristics which are suited to the particular player. It has also been proposed to provide a fluted aperture whose diameter varies across the thickness of the putter head, and in particular an increasing diameter of aperture from the top surface of the putter head to the bottom surface thereof would allow an earlier release of the ball 82 therefrom. This may be of advantage in testing the short putting stroke of a player, or may be used in circumstances where the arc of swing of a player is approximately correct but requires slight fine tuning.

A yet further proposal is to provide an elastomeric ring on the inner surface of the aperture 14 to enable a player using the putter in conventional play to lift a ball from the ground by simply urging the putter head over the ball such that it locates within the aperture and engages the elastormeric ring to be subsequently held thereby.

To enhance the overall aesthetic appearance of the putter head 2, caps may be provided to cover the aperture either on the upper surface thereof and/or on the lower surface such caps could be of use in identification purposes or alternatively may be provided with further alignment features to enhance the alignment capabilities of the putter head and the player as a whole.

Both caps and any insert or plugs provided within the aperture may be transparent, and indeed the entire putter head may be manufactured of a transparent material.

A yet further insert may comprise a weight with one or more recesses provided in its uppermost surface such that a user of the putter and insert can rotate the weight when disposed within the aperture to provide the putter head with altered dynamic and vibrational characteristics to suit the particular preference of the player. The rotation of said weight could easily be prevented by a simple locking device such as a grub screw tightenable against the surface of the weight using an allen key inserted through a conveniently disposed aperture in the putter head.

It will be immediately evident to those skilled in the art that a wide variety of modifications and amendment may be made to the invention without exceeding the scope or departing from the spirit thereof.

What is claimed is:

1. A method of improving the putting stroke of a golfer using a putter as a training device, said putter having a club head with at least one striking face at the base of which is a front edge from which rearwardly extend side edges, said side edges ultimately developing into a rear edge, said front, side and rear edges defining the base shape of the club head which further has a predetermined thickness, said club head base shape including an aperture defined throughout the thickness of the club head behind the striking face, said aperture being of a size and shape capable of receiving a golf ball which can pass through the aperture without hindrance from the edges or sides which define said aperture, said putting stroke including a backswing, a downswing, and a follow through, said method including the steps of placing a first golf ball in said aperture when the club head is stationary on a surface prior to commencing the stroke, placing a second golf ball immediately in front of the striking face of the putter and also in alignment with the first golf ball so that both first and second golf balls are on the notional line on said surface in which direction it is desired to cause the second ball to travel, firstly executing a controlled backswing so that the club head rises above the surface by a distance less than the diameter of a golf ball thus causing the first ball to roll along the surface but ensuring said first ball is retained in the aperture, secondly executing a downswing whereby the club is accelerated from the top of the backswing towards its starting position until the striking face impacts the second ball and causes it to move in an impact direction, and finally executing a follow through whereby the club head is raised above said surface by an amount greater than the diameter of a golf ball so that the first ball is released from the aperture in a release direction dependent on the direction of travel of the club head at the moment of release, the impact direction and the release direction being ideally identical and easily distinguishable in the event that they are different by virtue of the divergence of the first and second balls as they travel in different directions.

2. A method of improving the putting stroke of a golfer using a putter as a training device, said putter having a club head with at least one striking face at the base of which is a front edge from which rearwardly extend side edges, said side edges ultimately developing into a rear edge, said front, side and rear edges defining the base shape of the club head which further has a predetermined thickness, said club head base shape including a channel defined throughout the thickness of the club head behind the striking face and having a rearmost dimensional size measured parallel to the striking face of at least the diameter of a golf ball so that such a golf ball is not hindered moving into and from said channel, said putting stroke including a backswing, a downswing, and a follow through, said method including the steps of placing a first golf ball in said channel when the club head is stationary on a surface prior to commencing the stroke, marking said surface with an indicator means behind the first golf ball extending in a straight line rearwardly therefrom and perpendicular to the striking face of the club at rest, executing a controlled backswing causing the first ball to roll along the surface until no longer in contact with the rear most edge of the club head at which time the momentum already imparted to said first ball causes same to continue rolling in a release direction dependent on the club head motion at the moment of deceleration of said club head towards the end of the backswing, said release direction being ideally identical to the direction in which said indicator means extends on said surface when the backswing is correctly executed and easily distinguishable therefrom in the event that the release direction is different.

3. A method according to claim 2 including the steps of applying a second indicator means to the surface in front of the striking face and extending perpendicularly away therefrom in front of said striking face, and placing a second golf ball on the surface in front of the striking face before the commencement of the stroke such that when the downswing and follow through sections of the stroke are executed, the striking face impacts the second golf ball propelling same in an impact direction which is ideally collinear with the second indicator means over the length thereof when the striking face squarely impacts said second ball, said impact direction being easily distinguished from the direction of the indicator means when the impact was not square.

4. A method of improving the putting stroke of a golfer using a putter as a training device, said putter having a club head with at least one striking face at the base of which is a front edge from which rearwardly extend side edges, said side edges ultimately developing into a rear edge, said front, side and rear edges defining the base shape of the club head which further has a predetermined thickness, said club head base shape including an aperture defined throughout the thickness of the club head behind the striking face, said aperture being of a size and shape capable of receiving a golf ball which can pass through the aperture without hindrance from the edges or sides which define said aperture, said putting stroke including a backswing, a downswing, and a follow through, said method including the steps of placing a first golf ball in said aperture when the club head is stationary on a surface prior to commencing the stroke, marking said surface with an indicator means in front of the striking face of the club in straight line and extending forward therefrom in a direction perpendicular to said striking face of the club when in the stationary position, firstly executing a controlled backswing so that the club head rises above the surface by a distance less than the diameter of a golf ball thus causing the first ball to roll along the surface but ensuring said first ball is retained in the aperture, secondly executing a downswing whereby the club is accelerated from the top of the backswing towards its starting position, and finally executing a follow through whereby the club head is raised above said surface by an amount greater than the diameter of a golf ball so that the first ball is released from the aperture in a release direction dependent on the direction of travel of the club head at the moment of release, the release direction and the direction of the indicator means being ideally identical when the follow through is correctly executed and easily distinguishable in the event that the two directions are different by virtue of the divergence of the first ball from the indicator means as they travel in different directions.

5. A method according to claim 4 including the step of placing a second golf ball in front of the striking face before the commencement of the stroke such that when the downswing and follow through sections of the stroke are executed, the striking face impacts the second golf ball propelling same in an impact direction which is ideally collinear with the indicator means over the length thereof when the striking face squarely impacts said second ball, said impact direction being easily distinguished from the direction of the indicator means when the impact was not square, and said first ball being released from said aperture in a release direction which is ideally the same as both the direction of the indicator means and the impact direction when the stroke is correctly executed, said release direction being clearly distinguishable from the impact and indicator means directions if different therefrom by virtue of the divergence of the first ball from the second ball and in directions other than collinearly with the indicator means.

6. A method of improving the putting stroke of a golfer using a putter having an attachment secured thereto as a training device, said putter having a club head with a striking face, said attachment being secured to said club head so as to be behind the striking face and defining an aperture being of a size and shape capable of receiving a golf ball which can pass through the aperture without hindrance from the edges or sides which define said aperture, the mounting of said attachment to the club head being such that the defined aperture is disposed entirely behind said club head, said putting stroke including a backswing, a downswing, and a follow through, said method including the steps of placing a first golf ball in said aperture when the club head is stationary on a surface prior to commencing the stroke, placing a second golf ball immediately in front of the striking face of the putter and also in alignment with the first golf ball so that both first and second golf balls are on the notional line on said surface in which direction it is desired to cause the second ball to travel, firstly executing a controlled backswing so that the club head rises above the surface by a distance less than the diameter of a golf ball thus causing the first ball to roll along the surface but ensuring said first ball is retained in the aperture, secondly executing a downswing whereby the club is accelerated from the top of the backswing towards its starting position until the striking face impacts the second ball and causes it to move in an impact direction, and finally executing a follow through whereby the club head is raised above said surface by an amount greater than the diameter of a golf ball so that the first ball is released from the aperture in a release direction dependent on the direction of travel of the club head at the moment of release, the impact direction and the release direction being ideally identical and easily distinguishable in the event that they are different by virtue of the divergence of the first and second balls as they travel in different directions.

7. A method of improving the putting stroke of a golfer using a putter having an attachment secured thereto as a training device, said putter having a club head with a striking face, said attachment being secured to said club head so as to be behind the striking face and having a pair of arms extending rearwardly to define a channel behind the striking face and having a rearmost dimensional size measured parallel to the striking face of at least the diameter of a golf ball so that such a golf ball is not hindered moving into and from said channel, said putting stroke including a backswing, a downswing, and a follow through, said method including the steps of placing a first golf ball in said channel when the club head is stationary on a surface prior to commencing the stroke, marking said surface with an indicator means behind the first golf ball extending in a straight line rearwardly therefrom and perpendicular to the striking face of the club at rest, executing a controlled backswing causing the first ball to roll along the surface until no longer in contact with the rear most edge of the channel at which time the momentum already imparted to said first ball causes same to continue rolling in a release direction dependent on the club head motion at the moment of deceleration of said club head towards the end of the backswing, said release direction being ideally identical to the direction in which said indicator means extends on said surface when the backswing is correctly executed and easily distinguishable therefrom in the event that the release direction is different.

8. A method of improving the putting stroke of a golfer using a putter having an attachment secured thereto as a training device, said putter having a club head with a striking face, said attachment being secured to said club head so as to be behind the striking face and defining an aperture being of a size and shape capable of receiving a golf ball which can pass through the aperture without hindrance from the edges or sides which define said aperture, said putting stroke including a backswing, a downswing, and a follow through, said method including the steps of placing a first golf ball in said aperture when the club head is stationary on a surface prior to commencing the stroke, marking said surface with an indicator means in front of the striking face of the club in straight line and extending forward therefrom in a direction perpendicular to said striking face of the club when in the stationary position, firstly executing a controlled backswing so that the club head rises above the surface by a distance less than the diameter of a golf ball thus causing the first ball to roll along the surface but ensuring said first ball is retained in the aperture, secondly executing a downswing whereby the club is accelerated from the top of the backswing towards its starting position, and finally executing a follow through whereby the club head is raised above said surface by an amount greater than the diameter of a golf ball so that the first ball is released from the aperture in a release direction dependent on the direction of travel of the club head at the moment of release, the release direction and the direction of the indicator means being ideally identical when the follow through is correctly executed and easily distinguishable in the event that the two directions are different by virtue of the divergence of the first ball from the indicator means as they travel in different directions.

9. A method according to claim 8 including the step of placing a second golf ball in front of the striking face before the commencement of the stroke such that when the downswing and follow through sections of the stroke are executed, the striking face impacts the second golf ball propelling same in an impact direction which is ideally collinear with the indicator means over the length thereof when the striking face squarely impacts said second ball, said impact direction being easily distinguished from the direction of the indicator means when the impact was not square, and said first ball being released from said aperture in a release direction which is ideally the same as both the direction of the indicator means and the impact direction when the stroke is correctly executed, said release direction being clearly distinguishable from the impact and indicator means directions if different therefrom by virtue of the divergence of the first ball from the second ball and in directions other than collinearly with the indicator means.

* * * * *